United States Patent [19]

Lefebvre et al.

[11] Patent Number: 4,474,234

[45] Date of Patent: Oct. 2, 1984

[54] SAFETY VALVE INSTALLED BELOW AN ACTIVATION PUMP IN A HYDROCARBON PRODUCTION WELL

[75] Inventors: Herve M. Lefebvre, par Chartres; Francois C. Gueuret, Voisins le Bretonneux, both of France

[73] Assignee: Compagnie Francaise des Petroles, Boulogne-Billancourt, France

[21] Appl. No.: 445,780

[22] Filed: Dec. 1, 1982

[30] Foreign Application Priority Data

Dec. 2, 1981 [FR] France ..... 81 22544

[51] Int. Cl.[3] ..... E21B 34/08; E21B 43/12

[52] U.S. Cl. ..... 166/105; 166/106; 166/321; 166/322; 166/332

[58] Field of Search ..... 166/105, 106, 68, 321, 166/322, 324, 332, 334, 72

[56] References Cited

U.S. PATENT DOCUMENTS

| | | | |
|---|---|---|---|
| 1,674,815 | 6/1928 | Barnhart | 166/68 |
| 3,040,811 | 6/1962 | Pistole et al. | 166/72 |
| 3,045,760 | 7/1962 | Moore, Jr. | 166/324 |
| 3,092,135 | 6/1963 | Brown et al. | 166/321 |
| 3,614,984 | 10/1971 | Schexnaider | 166/334 |
| 3,799,204 | 3/1974 | Watkins et al. | 166/322 |
| 4,009,756 | 3/1977 | Zehren | 166/68 |
| 4,134,454 | 1/1979 | Taylor | 166/324 |

FOREIGN PATENT DOCUMENTS

| | | | |
|---|---|---|---|
| 2083524 | 3/1982 | United Kingdom | 166/105 |

*Primary Examiner*—James A. Leppink
*Assistant Examiner*—Hoang C. Dang
*Attorney, Agent, or Firm*—Sughrue, Mion, Zinn, Macpeak & Seas

[57] ABSTRACT

In a hydrocarbon production well in which the effluent is activated by an activation pump removably installed in a production pipe in the well, a safety valve is removably mounted in the production pipe below the activation pump. The safety valve comprises, in a lower part of the valve body, a foot valve and thereabove an obturator which is moved to its open position by an operating member which is provided with a piston slideably mounted in the valve body and separating first and second chambers. The first chamber is pressurized to open the valve, and the second chamber, which acts in opposition to the first chamber, is in communication with the bottom of the well below the foot valve, and is thus isolated from the interior of the safety valve when the foot valve is closed.

4 Claims, 5 Drawing Figures

SAFETY VALVE INSTALLED BELOW AN ACTIVATION PUMP IN A HYDROCARBON PRODUCTION WELL

The invention relates to a safety valve installed below an effluent activation pump inside a hydrocarbon production well.

Safety valves have already been proposed which are associated with activation pumps driven by electric motors, and in which a chamber controlling the opening of the valve is in communication with the outlet of the pump in such a manner that the fluid produced at the outlet serves as fluid controlling the opening of the safety valve. An arrangement of this type is described in U.S. Pat. No. 3,807,894. A major disadvantage of an arrangement of this kind is due to the fact that the assembly comprising the valve and the pump constitutes a unit inseparable from the production pipe.

One aim of the invention is to provide a safety valve which is installed below an activation pump, which in turn is disposed in a production pipe and can be withdrawn therefrom by a simple cable operation.

One major problem consists in that the safety valve must open before the pump operates. If the product fluid is used for controlling the opening of the valve, and if the well bottom installation does not make it possible to install a non-return valve in order to prevent the circulation of fluid from the pump outlet to the pump inlet, inside the pump, or if it is not desired to install such a non-return valve, when the installation is started up a pressure close to the pressure in the chamber controlling the opening of the safety valve will be formed in the effluent passage through the safety valve, and the safety valve cannot open if this pressure in the said effluent passage reaches a chamber acting in opposition to the chamber controlling the opening of the valve. A similar phenomenon would occur in jet pump installations, even if controlling the opening of the safety valve by the pump driving fluid were contemplated.

It is possible to envisage overcoming this difficulty by using a safety valve of the precompressed gas chamber type, this chamber acting in opposition to the chamber controlling the opening. A safety valve of this type has been described in U.S. Pat. No. 3,782,461, for the purpose of effecting the closure of the valve.

However, a compressed gas chamber, whether used for closing the valve or for enabling it to be opened, or for both these purposes, is a component which increases the risk of failure of the valve.

One aim of the invention is to make it possible to produce a safety valve which is installed below an activation pump, which is in turn disposed in a production pipe and may be withdrawn therefrom by a cable operation, which safety valve enables the use of a precompressed gas chamber to be avoided.

According to the invention there is provided a safety valve installed below an effluent activation pump in a production pipe in a hydrocarbon production well, comprising a valve body, a first chamber provided in said body for controlling opening of the valve and a second chamber provided in said body acting in opposition to said first chamber, a foot valve fixed in a lower part of said body, and means providing communication between said second chamber and the well below said foot valve.

The valve may be disposed in the production pipe in such manner that the valve body is applied by sealing means against the production pipe at the top of the valve, an intermediate space, open at the bottom, being provided below the sealing means, between the valve body and the production pipe. The second chamber is in communication with the said intermediate space.

Thus, the pressure of fluid in the second chamber is the pressure at the well bottom and is independent of the pressure which may arise in the effluent passage through the safety valve when the foot valve is closed.

Embodiments according to the invention will now be described, by way of example only, with reference to the accompanying drawings.

Figure 1:
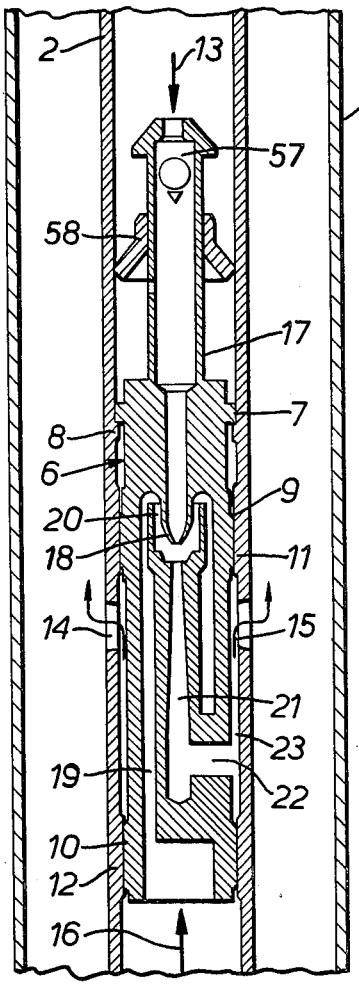
FIGS. 1 and 2 show, in longitudinal section, two portions, succeeding one another in the direction from top to bottom, of the bottom part of a petroleum production well, with an embodiment of a safety valve and a jet type activation pump.
Figure 2:
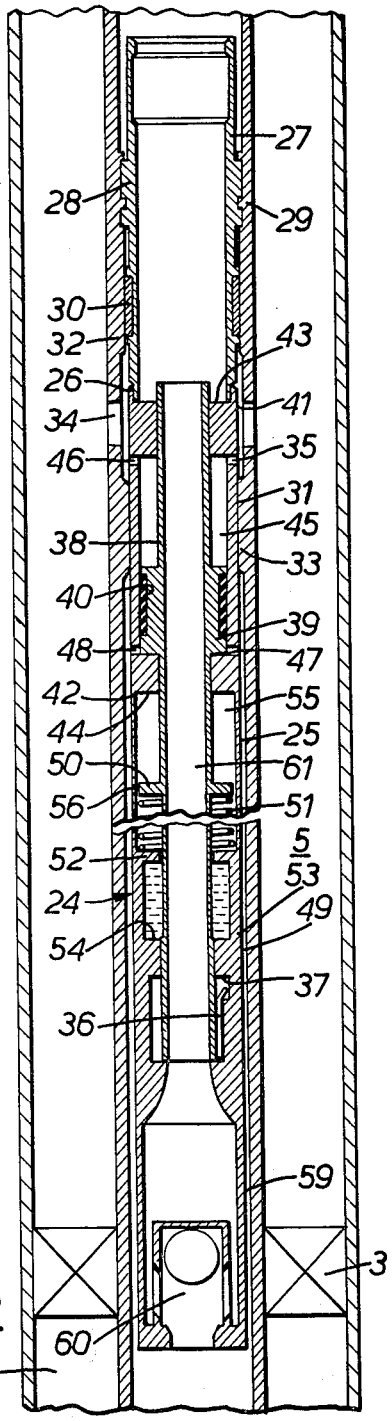

According to FIGS. 1 and 2, the petroleum well comprises a casing 1, inside which is disposed a production pipe or tubing 2. A sealing device or packer 3 is installed between the tubing 2 and the casing 1 in order to isolate the portion 4 of the annular space formed between the tubing and the casing at the bottom of the well from the portion 5 of the annular space lying above the packer 3.

An activation pump 6, which is here of the hydraulic ejector type, is retained by a collar 7 bearing against a stop 8 provided inside the tubing 2. Externally this pump is provided with two sealing packings 9 and 10, which are applied against two shoulders 11 and 12 provided inside the tubing 2. Internally this pump has passages for the driving fluid passing down from the surface in the direction of the arrow 13 inside the tubing 2 and passing out of the tubing 2 through openings 14 in the direction of the arrows 15, then rising in the annular space 5, and also has passages combined with the previously mentioned passages and intended for the effluent which rises from the bottom of the well in the direction of the arrow 16, inside the tubing 2, and which passes out of the tubing 2, after mixing with the driving fluid, as shown by the arrows 15. These fluid passages comprise: a driving fluid inlet pipe 17 followed by an injector 18, a rising vertical effluent inlet passage 19 followed by an annular passage 20, in which the direction of flow of the effluent is reversed and which has its outlet downstream of the injector 18, and an ejector 21. The latter is disposed downstream of the injector 18 and of the effluent inlet facing the injector, and it sucks in a mixture of driving fluid and effluent, this mixture constituting the product fluid. This product fluid leaves the pump 6 through an opening 22, passes into a space 23 formed between the pump 6, the tubing 2 and the sealing packings 9 and 10, and passes out of the tubing 2 through the openings 14 in the direction of the arrows 15, then rising in the annular space 5.

Below the pump 6, but independently of it, a safety valve 24 is installed in the tubing 2. The body 25 of this safety valve is mounted at the top, by means of a coupling 26, for example a screw coupling, to a lock mandrel 27 provided with anchoring means 28 cooperating with an anchoring sleeve or nipple 29 on the tubing 2. The lock mandrel 27 and the body 25 of the valve 24 are provided externally with sealing packings 30 and 31 respectively, which are applied against internal shoulders 32 and 33 respectively on on the tubing 2. The tubing 2 comprises openings 34 disposed between these shoulders 32 and 33 and permitting the admission, for the purpose of operating the safety valve, of the product fluid contained in the annular space 5 into a first intermediate space 35 bounded by the body 25, the tubing 2 and the sealing packings 30 and 31.

The safety valve body 25 carries a swinging flap 36, which is normally in the raised horizontal position, in which it bears against a seat 37 and closes the valve 24. The valve 24 is opened by the lowering of the flap 36 into the vertical position shown in FIG. 2, this lowering of the flap 36 being effected by the downward movement of an internal sleeve 38 sliding inside the body 25.

The safety valve is provided with an opening control system. For this purpose the sleeve 38 carries a first piston 39 provided with sealing packings 40 and sliding sealingly inside the body 25 between two shoulders 41 and 42 in the body, which shoulders are provided with sealing packings 43 and 44 respectively, applied against the sleeve 38. On each side of the piston 39 there are thus formed, respectively, a chamber 45 communicating by way of apertures 46 with the space 35 and a chamber 47 communicating by way of apertures 48 with a second intermediate space 49, which is cylindrical and annular and is formed between the tubing 2 and the body 25 below the shoulder 33 and below the sealing packing 31, this space 49 being open at the bottom. Thus, the piston 39 is subjected on its upper face to the pressure of the product fluid lying at the bottom of the annular space 5, and on its lower face to the pressure of the effluent at the bottom of the well.

The safety valve is provided with a system returning it to the closed position. For this purpose the sleeve 38 carries a second piston 50 acted on by a spring 51, which bears against an internal shoulder 52 on the body 25 and urges the sleeve 38 in the upward direction. Below the internal shoulder 52 the body 25 has a shoulder 53 which bears, through a sealing packing 54, against the sleeve 38. A chamber 55, bounded by the body 25, the sleeve 38, the shoulder 42, the packing 44, the shoulder 53, and the packing 54, is filled with oil, while a calibrated passage 56 is provided between the piston 50 and the body 25, in such a manner as to form a shock absorber system which retards the displacement of the piston 50 and, consequently, of the sleeve 38.

In order to be able to raise the pump by reversed pumping, that is to say the delivery of pressurised fluid into the annular space 5, the pipe 17 of the pump 6 has been provided with a check valve 57 and with cups 58. Reversed pumping also presupposes the installation of a foot valve at the bottom of the tubing 2. This foot valve has here been mounted on a downward extension 59 of the valve body 25 instead of on the tubing 2, and is given the reference 60. This foot valve serves a purpose in addition to that of permitting reversed pumping, because of its installation on this extension 59. When it is closed, in fact, it makes it possible to isolate the passage 61, provided inside the valve 24 for the effluent, from the second intermediate space 49. The installation of the foot valve 60 on the extension 59 of the safety valve body 25 is therefore retained even if reversed pumping is not envisaged.

The opening of the flap 36 is facilitated if the volume of fluid trapped between the flap 36 and the foot valve 60 is considerable and/or if the foot valve 60 is not perfectly tight. Similarly, it is preferable for the check valve 57 not to be perfectly tight, in order to ensure that the movement of the sleeve 38 is not hampered.

In this example it has been assumed that it was desired to have the safety valve 24 mounted in the tubing 2 independently of the mounting of the activation pump, in order to be able to withdraw the latter while retaining security at the bottom of the well. Otherwise, it would also be possible for the pump and the safety valve to be combined as a single unit mounted in the tubing in such a manner as to be able to be withdrawn together by operating a cable.

The pressure equalisation systems which can be used in order to permit the deanchoring of the safety valve have not been shown in FIGS. 1 and 2, because these systems are conventional.

If the well is eruptive, the equalisation of pressures can also be achieved by pressurising the tubing 2, which causes the inner sleeve 38 to move down and opens the flap 36 but locks the foot valve 60 in the closed position, then lowering a deanchoring tool in order to lock the inner sleeve 38 in the lowered position, and finally reducing the pressure in the tubing until equalisation is achieved. If the well is not eruptive, a light fluid may be injected, or else downward percussion may be effected, whereby, as soon as detachment occurs, the lock mandrel is moved downwards.

The drawings also do not show the surface installations which make it possible to effect hydraulic pumping and, optionally, reversed pumping. In many cases it will also be possible to dispose on the surface a device producing adjustable back-pressure in the annular space 5. This device may in particular consist of an adjustable back-pressure check valve.

The procedure for opening the safety valve and starting pumping may be as follows:

At the surface the adjustable back-pressure in the annular space 5 is adjusted to approximately the maximum value Pc which the installation can withstand;

At the surface the driving fluid in the tubing 2 is gently pressurised to the value Pc, which brings about: the opening of the flap 36 of the safety valve by equalising pressure on each side of the flap; the progressive downward movement of the sleeve 38, whose piston 39 is subjected at the top to the sum of the pressure established at the surface and the hydrostatic pressure of the driving fluid and at the bottom to the static pressure of the well; and finally the complete opening of the flap 36 through the complete lowering of the sleeve 38;

The injection of the driving fluid into the tubing 2 is commenced, thus permitting the progressive starting of the pump 6 while holding the safety valve 24 open, the risk of the closing of the latter being avoided by the delay system disposed in the chamber 55;

The back-pressure in the annular space 5 is progressively reduced until it reaches the flow pressure at the well head.

The closing phase of the safety valve 24 takes place automatically as soon as the pressure difference between the suction and delivery sides of the pump 6 is cancelled out. However, this closure does not take place if the well is not eruptive, because the weight of the column of fluid in the annular space 5 then tends to close the foot valve 60, thus preventing the equalisation of pressure on the two sides of the piston 39. The safety valve therefore closes only if eruption or flow occurs at its level; thus, whatever the flow pressure, it always serves its purpose of prevention in the event of eruption.

The return force of the spring 51 must be sufficient to overcome the dead weight of the sliding sleeve 38 and of the members fastened to it, and also the friction of the seals. The spring 51 may optionally be replaced by diaphragm springs.

Figure 3:
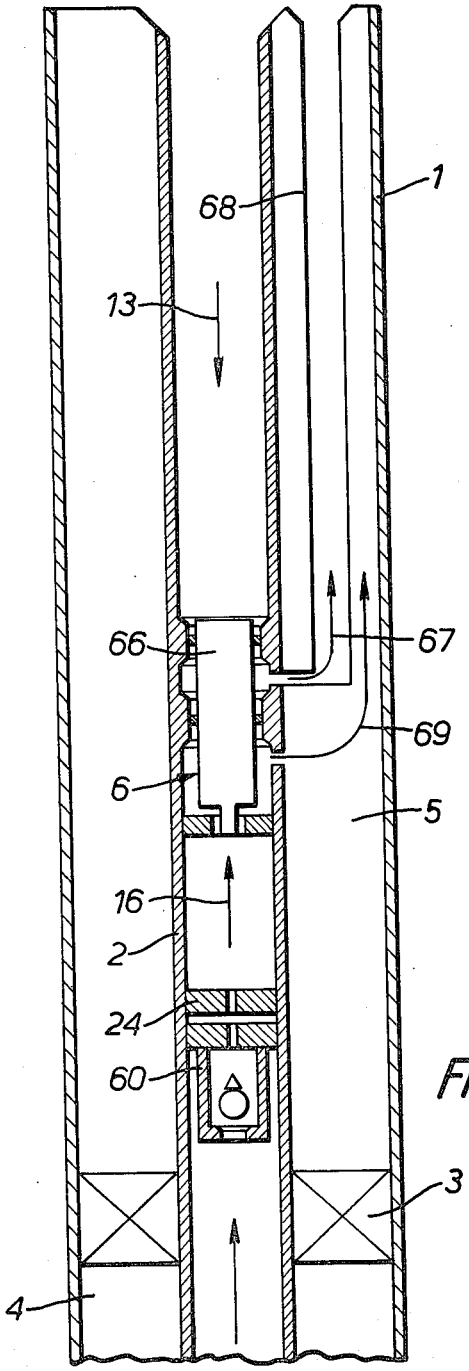
FIG. 3 shows, more schematically and to a smaller scale, a bottom part of a petroleum well with a hydraulic pump having separate circuits for the driving fluid and the product fluid.
Figure 4:
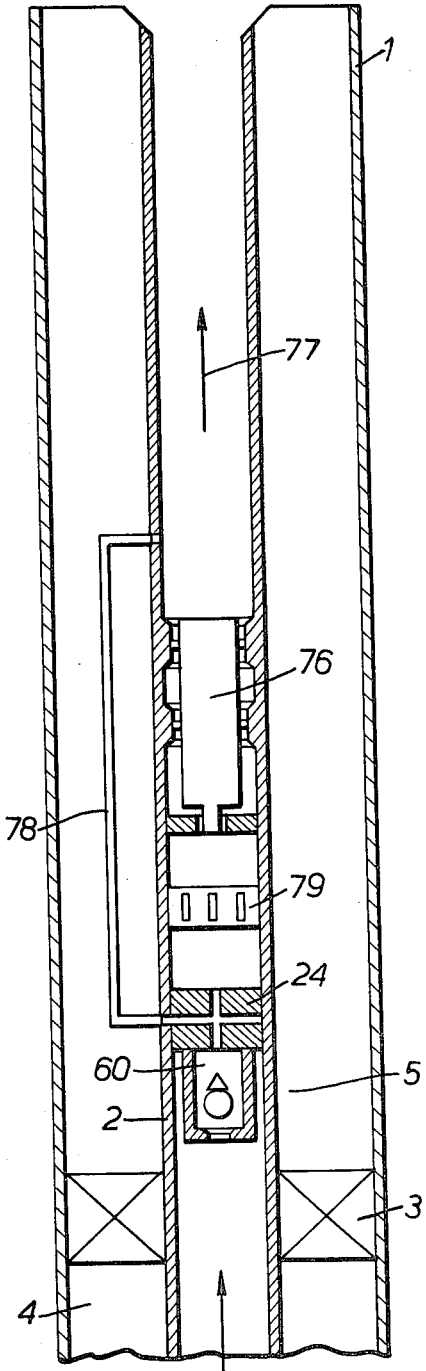
FIGS. 4 and 5 are similar diagrams to that shown in FIG. 3 in the case of an electric pump and a rod pump respectively.
Figure 5:
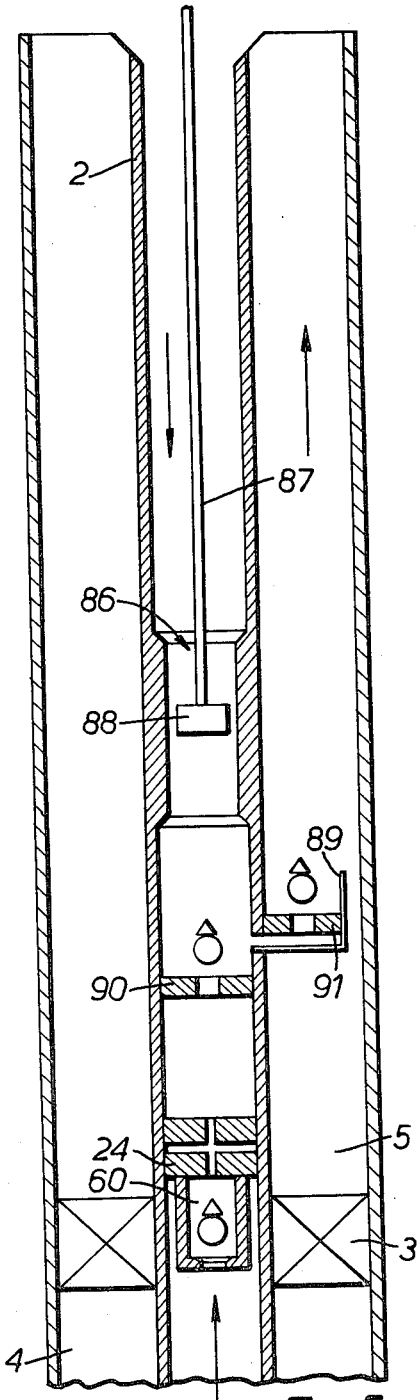

In the above embodiment it has been assumed that the pump was of the ejector type, but it is also possible to use a hydraulic pump in which the driving fluid is separate from the product fluid, a rod pump, or an electric pump suspended at the end of a cable, as will be seen in connection with the examples illustrated in FIGS. 3, 4 and 5.

A safety valve 24 of the clack type has been shown, but a different type of obturator could be used. Similarly, the safety valve could be operated by a member other than a central sliding sleeve, for example by rods disposed on the periphery of the safety valve.

The connection between the operating member of the safety valve and the piston to which the control pressure is applied need not be rigid, but could contain an intermediate resilient means such as a spring, so as to reduce the force by which this operating member bears on the obturator of the safety valve.

In FIG. 3 the casing 1, the tubing 2, the packer 3 and the safety valve 24 with the foot valve 60 can be seen once again, these two valves being represented very schematically but being in fact constructed and mounted in accordance with FIGS. 1 and 2. The hydraulic activation pump 66 here has a separate circuit for the driving fluid arriving in accordance with the arrow 13 and returning upwards in a special pipe 68 in accordance with the arrow 67, and for the product fluid which enters the pump 66 in accordance with the arrow 16 and leaves it in accordance with the arrow 69, thereupon rising in the annular space 5. On starting up, a pressurised fluid is passed into the annular space 5 from the surface.

In FIG. 4 an electric pump suspended on a cable (not shown) is provided, or else a rod pump 76 which delivers into the interior of the tubing 2 in accordance with the arrow 77, while a pipe 78 conducts the product fluid into the safety valve 24 in order to effect its opening. On starting up, a pressurised fluid is delivered into the tubing 2 from the surface. A sliding gate valve 79 may be interposed between the pump 76 and the safety valve 24 in order to transmit the dynamic liquid level, corresponding to the suction pressure, in the annular space 5. It is thus possible to free a part of the gas contained in the effluent at the inlet of the pump.

FIG. 5 shows the use of a pump 86 comprising a rod 87 and plunger 88, which in its downward movement delivers either into the annular space 5 or into a pipe 89 adjacent to the tubing 2. Check valves 90 and 91 ensure the operation of the pump. This arrangement is used for pumping highly viscous effluents. On starting up the safety valve 24 is opened by passing a pressurised fluid into the annular space 5 from the surface.

These examples simply illustrate possible applications of the invention, but numerous modifications may be made to them without departing from the scope of the invention.

What is claimed:

1. A safety valve for a hydrocarbon production well, said hydrocarbon production well comprising production pipe, an effluent activation pump mounted within said production pipe, said safety valve installed within said production pipe below said effluent activation pump, said safety valve comprising a valve body within said production pipe, a seat member within said valve body, a moving obturator within said valve body for sealing contact with said seat member, a slidable sleeve within said production pipe and operatively coupled to said obturator for moving said obturator, an annular piston fast with said sleeve and sealingly sliding inside said valve body, two shoulders fast with said valve body to define the limits of movement of said sleeve, said annular piston forming with said sleeve and said shoulder a first chamber adjacent one side of said piston and a second chamber adjacent the other side of said piston, means for supplying a pressure fluid to said first chamber for controlling opening of said valve, and a foot valve for allowing fluid flow upwardly but not downwardly fixed in a lower portion of said valve body, below said safety valve, and means providing a permanent communication between said second chamber and the well below said foot valve, whereby the pressure of the fluid in said second chamber is the pressure at the well bottom and is independent of the pressure which may arise in the effluent passage through the safety valve when the foot valve is closed.

2. A safety valve according to claim 1, wherein annular sealing means applies said valve body against said production pipe at an upper part of said safety valve, means open at its lower end forming an annular space below said sealing means between said valve body and said production pipe, and wherein said second chamber is in permanent communication with said annular space.

3. A safety valve according to claim 2, wherein said first chamber is situated above the piston and said second chamber is situated beneath it, wherein said first chamber is connected to the outside of said valve body through at least one opening situated above said sealing means, and said second chamber is in permanent communication with said annular space through at least one opening in said valve body below said sealing means.

4. A safety valve according to claim 3, wherein said valve body contains from top to bottom and between said second chamber and said foot valve, shock absorber delaying means, and the seat member of the safety valve.

* * * * *